US008360040B2

(12) United States Patent
Stewart et al.

(10) Patent No.: US 8,360,040 B2
(45) Date of Patent: Jan. 29, 2013

(54) ENGINE CONTROLLER

(75) Inventors: Gregory E. Stewart, North Vancouver (CA); Michael L. Rhodes, Richfield, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/353,178

(22) Filed: Jan. 18, 2012

(65) Prior Publication Data

US 2012/0116649 A1 May 10, 2012

Related U.S. Application Data

(63) Continuation of application No. 12/973,704, filed on Dec. 20, 2010, now Pat. No. 8,109,255, which is a continuation of application No. 12/144,445, filed on Jun. 23, 2008, now Pat. No. 7,878,178, which is a continuation of application No. 11/206,404, filed on Aug. 18, 2005, now Pat. No. 7,389,773.

(51) Int. Cl.
*F02D 41/00* (2006.01)

(52) U.S. Cl. ..... 123/672; 701/104; 701/105

(58) Field of Classification Search ..... 701/103–106, 701/109; 123/672, 673, 691, 435, 472, 478, 123/479, 480, 299, 300, 305, 456, 457; 60/285, 60/286

See application file for complete search history.

(56) References Cited

U.S. PATENT DOCUMENTS

| | | | |
|---|---|---|---|
| 3,744,461 | A | 7/1973 | Davis |
| 4,005,578 | A | 2/1977 | McInerney |
| 4,055,158 | A | 10/1977 | Marsee |
| 4,206,606 | A | 6/1980 | Yamada |
| 4,252,098 | A | 2/1981 | Tomczak et al. |
| 4,359,991 | A | 11/1982 | Stumpp et al. |
| 4,383,441 | A | 5/1983 | Willis et al. |
| 4,426,982 | A | 1/1984 | Lehner et al. |
| 4,438,497 | A | 3/1984 | Willis et al. |
| 4,440,140 | A | 4/1984 | Kawagoe et al. |
| 4,456,883 | A | 6/1984 | Bullis et al. |
| 4,485,794 | A | 12/1984 | Kimberley et al. |
| 4,601,270 | A | 7/1986 | Kimberley et al. |
| 4,616,308 | A | 10/1986 | Morshedi et al. |
| 4,653,449 | A | 3/1987 | Kamei et al. |
| 4,671,235 | A | 6/1987 | Hosaka |
| 4,677,559 | A | 6/1987 | Van Bruck |
| 4,735,181 | A | 4/1988 | Kaneko et al. |
| 4,947,334 | A | 8/1990 | Massey et al. |

(Continued)

FOREIGN PATENT DOCUMENTS

| | | |
|---|---|---|
| DE | 19628796 | 10/1997 |
| DE | 10219832 | 11/2002 |

(Continued)

OTHER PUBLICATIONS

"SCR, 400-csi Coated Catalyst," Leading NOx Control Technologies Status Summary, 1 page prior to Feb. 2, 2005.

(Continued)

*Primary Examiner* — Hai Huynh
(74) *Attorney, Agent, or Firm* — Seager Tufte & Wickhem LLC.

(57) ABSTRACT

A system for controlling fuel to an engine to minimize emissions in an exhaust of the engine. There may be a controller connected to an actuator, for example a fuel control actuator, of the engine and to emissions sensors, such as an NOx and/or PM sensor, proximate to an exhaust output of the engine. The controller, for example a speed controller, may have an input connected to an output of a pedal or desired speed setting mechanism. A speed sensor at a power output of the engine may be connected to an input of the controller.

20 Claims, 5 Drawing Sheets

U.S. PATENT DOCUMENTS 4,962,570 A 10/1990 Hosaka et al.
5,044,337 A 9/1991 Williams
5,076,237 A 12/1991 Hartman et al.
5,089,236 A 2/1992 Clerc
5,094,213 A 3/1992 Dudek et al.
5,095,874 A 3/1992 Schnaibel et al.
5,108,716 A 4/1992 Nishizawa
5,123,397 A 6/1992 Richeson
5,150,289 A 9/1992 Badavas
5,186,081 A 2/1993 Richardson et al.
5,233,829 A 8/1993 Komatsu
5,270,935 A 12/1993 Dudek et al.
5,273,019 A 12/1993 Matthews et al.
5,282,449 A 2/1994 Takahashi et al.
5,293,553 A 3/1994 Dudek et al.
5,349,816 A 9/1994 Sanbayashi et al.
5,365,734 A 11/1994 Takeshima
5,394,322 A 2/1995 Hansen
5,394,331 A 2/1995 Dudek et al.
5,398,502 A 3/1995 Watanabe
5,408,406 A 4/1995 Mathur et al.
5,431,139 A 7/1995 Grutter et al.
5,452,576 A 9/1995 Hamburg et al.
5,477,840 A 12/1995 Neumann
5,560,208 A 10/1996 Halimi et al.
5,570,574 A 11/1996 Yamashita et al.
5,598,825 A 2/1997 Neumann
5,609,139 A 3/1997 Ueda et al.
5,611,198 A 3/1997 Lane et al.
5,690,086 A 11/1997 Kawano et al.
5,692,478 A 12/1997 Nogi et al.
5,697,339 A 12/1997 Esposito
5,704,011 A 12/1997 Hansen et al.
5,746,183 A 5/1998 Parke et al.
5,765,533 A 6/1998 Nakajima
5,771,867 A 6/1998 Amstutz et al.
5,785,030 A 7/1998 Paas
5,788,004 A 8/1998 Friedmann et al.
5,842,340 A * 12/1998 Bush et al. ..... 60/274
5,846,157 A 12/1998 Reinke et al.
5,893,092 A 4/1999 Driscoll
5,942,195 A 8/1999 Lecea et al.
5,964,199 A 10/1999 Atago et al.
5,970,075 A 10/1999 Wasada
5,974,788 A 11/1999 Hepburn et al.
5,995,895 A 11/1999 Watt et al.
6,029,626 A 2/2000 Bruestle
6,035,640 A 3/2000 Kolmanovsky et al.
6,048,620 A 4/2000 Zhong
6,048,628 A 4/2000 Hillmann et al.
6,055,810 A 5/2000 Borland et al.
6,058,700 A 5/2000 Yamashita et al.
6,067,800 A 5/2000 Kolmanovsky et al.
6,076,353 A 6/2000 Fruedenberg et al.
6,105,365 A 8/2000 Deeba et al.
6,122,555 A 9/2000 Lu
6,134,883 A 10/2000 Kato et al.
6,153,159 A 11/2000 Engeler et al.
6,161,528 A 12/2000 Akao et al.
6,170,259 B1 1/2001 Boegner et al.
6,171,556 B1 1/2001 Burk et al.
6,178,743 B1 1/2001 Hirota et al.
6,178,749 B1 1/2001 Kolmanovsky et al.
6,208,914 B1 3/2001 Ward et al.
6,216,083 B1 4/2001 Ulyanov et al.
6,233,922 B1 5/2001 Maloney
6,236,956 B1 5/2001 Mantooth et al.
6,237,330 B1 5/2001 Takahashi et al.
6,242,873 B1 6/2001 Drozdz et al.
6,263,672 B1 7/2001 Roby et al.
6,273,060 B1 8/2001 Cullen
6,279,551 B1 8/2001 Iwano et al.
6,312,538 B1 11/2001 Latypov et al.
6,314,724 B1 * 11/2001 Kakuyama et al. ..... 60/285
6,321,538 B2 11/2001 Hasler
6,327,361 B1 12/2001 Harshavardhana et al.
6,338,245 B1 1/2002 Shimoda et al.
6,341,487 B1 1/2002 Takahashi et al.
6,347,619 B1 2/2002 Whiting et al.
6,360,159 B1 3/2002 Miller et al.
6,360,541 B2 3/2002 Waszkiewicz et al.
6,360,732 B1 3/2002 Bailey et al.
6,363,715 B1 4/2002 Bidner et al.
6,363,907 B1 4/2002 Arai et al.
6,379,281 B1 4/2002 Collins et al.
6,389,803 B1 5/2002 Surnilla et al.
6,425,371 B2 7/2002 Majima
6,427,436 B1 8/2002 Allansson et al.
6,431,160 B1 8/2002 Sugiyama et al.
6,445,963 B1 9/2002 Blevins et al.
6,446,430 B1 9/2002 Roth et al.
6,453,308 B1 9/2002 Zhao et al.
6,463,733 B1 10/2002 Asik et al.
6,463,734 B1 10/2002 Tamura et al.
6,466,893 B1 10/2002 Latwesen et al.
6,470,682 B2 10/2002 Gray, Jr.
6,470,862 B2 10/2002 Isobe et al.
6,470,886 B1 10/2002 Jestrabek-Hart
6,494,038 B2 * 12/2002 Kobayashi et al. ..... 60/285
6,502,391 B1 1/2003 Hirota et al.
6,512,974 B2 1/2003 Houston et al.
6,513,495 B1 2/2003 Franke et al.
6,532,433 B2 3/2003 Bharadwaj et al.
6,546,329 B2 4/2003 Bellinger
6,550,307 B1 4/2003 Zhang et al.
6,553,754 B2 4/2003 Meyer et al.
6,560,528 B1 5/2003 Gitlin et al.
6,560,960 B2 5/2003 Nishimura et al.
6,571,191 B1 5/2003 York et al.
6,579,206 B2 6/2003 Liu et al.
6,591,605 B2 7/2003 Lewis
6,594,990 B2 7/2003 Kuenstler et al.
6,601,387 B2 8/2003 Zurawski et al.
6,612,293 B2 9/2003 Schweinzer et al.
6,615,584 B2 9/2003 Ostertag
6,625,978 B1 9/2003 Eriksson et al.
6,629,408 B1 10/2003 Murakami et al.
6,637,382 B1 10/2003 Brehob et al.
6,644,017 B2 * 11/2003 Takahashi et al. ..... 60/285
6,647,710 B2 11/2003 Nishiyama et al.
6,647,971 B2 11/2003 Vaughan et al.
6,651,614 B2 11/2003 Flamig-Vetter et al.
6,662,058 B1 12/2003 Sanchez
6,666,198 B2 12/2003 Mitsutani
6,666,410 B2 12/2003 Boelitz et al.
6,671,603 B2 12/2003 Cari et al.
6,672,052 B2 1/2004 Taga et al.
6,672,060 B1 1/2004 Buckland et al.
6,679,050 B1 1/2004 Takahashi et al.
6,687,597 B2 2/2004 Sulatisky et al.
6,688,283 B2 2/2004 Jaye
6,694,244 B2 2/2004 Meyer et al.
6,694,724 B2 2/2004 Tanaka et al.
6,705,084 B2 3/2004 Allen et al.
6,718,254 B2 4/2004 Hashimoto et al.
6,718,753 B2 4/2004 Bromberg et al.
6,725,208 B1 4/2004 Hartman et al.
6,736,120 B2 5/2004 Surnilla
6,739,122 B2 5/2004 Kitajima et al.
6,742,330 B2 6/2004 Genderen
6,743,352 B2 6/2004 Ando et al.
6,748,936 B2 6/2004 Kinomura et al.
6,752,131 B2 6/2004 Poola et al.
6,752,135 B2 6/2004 McLaughlin et al.
6,758,037 B2 7/2004 Terada et al.
6,760,631 B1 7/2004 Berkowitz et al.
6,760,657 B2 * 7/2004 Katoh ..... 701/104
6,760,658 B2 7/2004 Yasui et al.
6,770,009 B2 8/2004 Badillo et al.
6,772,585 B2 8/2004 Iihoshi et al.
6,779,344 B2 8/2004 Hartman et al.
6,779,512 B2 8/2004 Mitsutani
6,788,072 B2 9/2004 Nagy et al.
6,789,533 B1 9/2004 Hashimoto et al.
6,792,927 B2 9/2004 Kobayashi
6,804,618 B2 10/2004 Junk
6,814,062 B2 11/2004 Esteghlal et al.

6,817,171 B2 11/2004 Zhu
6,823,667 B2 11/2004 Braun et al.
6,823,675 B2 11/2004 Brunell et al.
6,826,903 B2 12/2004 Yahata et al.
6,827,060 B2 12/2004 Huh
6,827,061 B2 12/2004 Nytomt et al.
6,827,070 B2 12/2004 Fehl et al.
6,834,497 B2 12/2004 Miyoshi et al.
6,839,637 B2 1/2005 Moteki et al.
6,849,030 B2 2/2005 Yamamoto et al.
6,874,467 B2 4/2005 Hunt et al.
6,879,906 B2 4/2005 Makki et al.
6,904,751 B2 6/2005 Makki et al.
6,911,414 B2 6/2005 Kimura et al.
6,915,779 B2 7/2005 Sriprakash
6,920,865 B2 7/2005 Lyon
6,925,372 B2 8/2005 Yasui
6,925,796 B2 8/2005 Nieuwstadt et al.
6,928,362 B2 8/2005 Meaney
6,928,817 B2 8/2005 Ahmad
6,931,840 B2 8/2005 Strayer et al.
6,934,931 B2 8/2005 Plumer et al.
6,941,744 B2 9/2005 Tanaka
6,945,033 B2 9/2005 Sealy et al.
6,948,310 B2 9/2005 Roberts, Jr. et al.
6,953,024 B2 10/2005 Linna et al.
6,965,826 B2 11/2005 Andres et al.
6,968,677 B2 11/2005 Tamura
6,971,258 B2 12/2005 Rhodes et al.
6,973,382 B2 12/2005 Rodriguez et al.
6,978,744 B2 12/2005 Yuasa et al.
6,996,975 B2 2/2006 Radhamohan et al.
7,000,379 B2 2/2006 Makki et al.
7,013,637 B2 3/2006 Yoshida
7,016,779 B2 3/2006 Bowyer
7,028,464 B2 4/2006 Rosel et al.
7,039,475 B2 5/2006 Sayyarrodsari et al.
7,047,938 B2 5/2006 Flynn et al.
7,052,434 B2 5/2006 Makino et al.
7,055,311 B2 6/2006 Beutel et al.
7,059,112 B2 6/2006 Bidner et al.
7,063,080 B2 * 6/2006 Kita et al. ..... 123/673
7,069,903 B2 7/2006 Surnilla et al.
7,082,753 B2 8/2006 Dalla Betta et al.
7,085,615 B2 8/2006 Persson et al.
7,106,866 B2 9/2006 Astorino et al.
7,107,978 B2 9/2006 Itoyama
7,111,450 B2 9/2006 Surnilla
7,111,455 B2 9/2006 Okugawa et al.
7,113,835 B2 9/2006 Boyden et al.
7,117,046 B2 10/2006 Boyden et al.
7,124,013 B2 10/2006 Yasui
7,149,590 B2 12/2006 Martin et al.
7,151,976 B2 12/2006 Lin
7,152,023 B2 12/2006 Das
7,155,334 B1 12/2006 Stewart et al.
7,165,393 B2 1/2007 Betta et al.
7,165,399 B2 1/2007 Stewart
7,168,239 B2 1/2007 Ingram et al.
7,182,075 B2 2/2007 Shahed et al.
7,184,845 B2 2/2007 Sayyarrodsari et al.
7,184,992 B1 2/2007 Polyak et al.
7,188,637 B2 3/2007 Dreyer et al.
7,194,987 B2 3/2007 Mogi
7,197,485 B2 3/2007 Fuller
7,200,988 B2 4/2007 Yamashita
7,204,079 B2 4/2007 Audoin
7,275,374 B2 10/2007 Stewart et al.
7,275,415 B2 10/2007 Rhodes et al.
7,292,926 B2 11/2007 Schmidt et al.
7,302,937 B2 12/2007 Ma et al.
7,321,834 B2 1/2008 Chu et al.
7,323,036 B2 1/2008 Boyden et al.
7,328,577 B2 2/2008 Stewart et al.
7,337,022 B2 2/2008 Wojsznis et al.
7,349,776 B2 3/2008 Spillane et al.
7,357,125 B2 4/2008 Kolavennu
7,375,374 B2 5/2008 Chen et al.
7,376,471 B2 5/2008 Das et al.
7,389,773 B2 6/2008 Stewart et al.
7,392,129 B2 6/2008 Hill et al.
7,398,149 B2 7/2008 Ueno et al.
7,400,967 B2 7/2008 Ueno et al.
7,413,583 B2 8/2008 Langer et al.
7,415,389 B2 8/2008 Stewart et al.
7,418,372 B2 8/2008 Nishira et al.
7,430,854 B2 10/2008 Yasui et al.
7,433,743 B2 10/2008 Pistikopoulos et al.
7,444,191 B2 10/2008 Caldwell et al.
7,444,193 B2 10/2008 Cutler
7,447,554 B2 11/2008 Cutler
7,467,614 B2 12/2008 Stewart et al.
7,469,177 B2 12/2008 Samad et al.
7,493,236 B1 2/2009 Mock et al.
7,515,975 B2 4/2009 Stewart
7,522,963 B2 4/2009 Boyden et al.
7,536,232 B2 5/2009 Boyden et al.
7,542,842 B2 6/2009 Hill et al.
7,577,483 B2 8/2009 Fan et al.
7,587,253 B2 9/2009 Rawlings et al.
7,591,135 B2 9/2009 Stewart
7,599,749 B2 10/2009 Sayyarrodsari et al.
7,599,750 B2 10/2009 Piche
7,627,843 B2 12/2009 Dozorets et al.
7,630,868 B2 12/2009 Turner et al.
7,634,323 B2 12/2009 Vermillion et al.
7,634,417 B2 12/2009 Boyden et al.
7,650,780 B2 1/2010 Hall
7,668,704 B2 2/2010 Perchanok et al.
7,698,004 B2 4/2010 Boyden et al.
7,702,519 B2 4/2010 Boyden et al.
7,743,606 B2 6/2010 Havlena et al.
7,752,840 B2 7/2010 Stewart
7,765,792 B2 8/2010 Rhodes et al.
7,793,489 B2 9/2010 Wang et al.
7,798,938 B2 9/2010 Matsubara et al.
7,826,909 B2 11/2010 Attarwala
7,831,318 B2 11/2010 Bartee et al.
7,840,287 B2 11/2010 Wojsznis et al.
7,844,351 B2 11/2010 Piche
7,844,352 B2 11/2010 Vouzis et al.
7,846,299 B2 12/2010 Backstrom et al.
7,850,104 B2 12/2010 Havlena et al.
7,856,966 B2 * 12/2010 Saitoh ..... 123/575
7,860,586 B2 12/2010 Boyden et al.
7,862,771 B2 1/2011 Boyden et al.
7,877,239 B2 1/2011 Grichnik et al.
7,878,178 B2 2/2011 Stewart et al.
7,904,280 B2 3/2011 Wood
7,905,103 B2 3/2011 Larsen et al.
7,907,769 B2 3/2011 Sammak et al.
7,930,044 B2 4/2011 Attarwala
7,933,849 B2 4/2011 Bartee et al.
7,958,730 B2 6/2011 Stewart
7,987,145 B2 7/2011 Baramov
7,996,140 B2 8/2011 Stewart et al.
8,019,911 B2 9/2011 Dressler et al.
8,025,167 B2 9/2011 Schneider et al.
8,032,235 B2 10/2011 Sayyar-Rodsari
8,060,290 B2 11/2011 Stewart et al.
8,078,291 B2 12/2011 Pekar et al.
8,109,255 B2 2/2012 Stewart et al.
2002/0116104 A1 8/2002 Kawashima et al.
2003/0089102 A1 5/2003 Colignon et al.
2003/0150961 A1 8/2003 Boelitz et al.
2004/0006973 A1 1/2004 Makki et al.
2004/0034460 A1 2/2004 Folkerts et al.
2004/0086185 A1 5/2004 Sun
2004/0117766 A1 6/2004 Mehta et al.
2004/0118107 A1 6/2004 Ament
2004/0165781 A1 8/2004 Sun
2004/0199481 A1 10/2004 Hartman et al.
2004/0221889 A1 11/2004 Dreyer et al.
2004/0226287 A1 11/2004 Edgar et al.
2005/0143952 A1 6/2005 Tomoyasu et al.
2005/0171667 A1 8/2005 Morita
2005/0187643 A1 8/2005 Sayyar-Rodsari et al.
2005/0193739 A1 9/2005 Brunell et al.

| | | | |
|---|---|---|---|
| 2005/0209714 | A1 | 9/2005 | Rawlings et al. |
| 2005/0210868 | A1 | 9/2005 | Funabashi |
| 2006/0047607 | A1 | 3/2006 | Boyden et al. |
| 2006/0111881 | A1 | 5/2006 | Jackson |
| 2006/0168945 | A1 | 8/2006 | Samad et al. |
| 2006/0265203 | A1 | 11/2006 | Jenny et al. |
| 2006/0282178 | A1 | 12/2006 | Das et al. |
| 2007/0142936 | A1 | 6/2007 | Denison et al. |
| 2007/0144149 | A1 | 6/2007 | Kolavennu et al. |
| 2007/0156259 | A1 | 7/2007 | Baramov et al. |
| 2007/0275471 | A1 | 11/2007 | Coward |
| 2008/0071395 | A1 | 3/2008 | Pachner |
| 2008/0097625 | A1 | 4/2008 | Vouzis et al. |
| 2008/0103747 | A1 | 5/2008 | Macharia et al. |
| 2008/0103748 | A1 | 5/2008 | Axelrud et al. |
| 2008/0104003 | A1 | 5/2008 | Macharia et al. |
| 2008/0109100 | A1 | 5/2008 | Macharia et al. |
| 2008/0125875 | A1 | 5/2008 | Stewart et al. |
| 2008/0132178 | A1 | 6/2008 | Chatterjee et al. |
| 2008/0183311 | A1 | 7/2008 | MacArthur et al. |
| 2008/0208778 | A1 | 8/2008 | Sayyar-Rodsari et al. |
| 2008/0244449 | A1 | 10/2008 | Morrison et al. |
| 2009/0005889 | A1 | 1/2009 | Sayyar-Rodsari |
| 2009/0008351 | A1 | 1/2009 | Schneider et al. |
| 2009/0043546 | A1 | 2/2009 | Srinivasan et al. |
| 2009/0131216 | A1 | 5/2009 | Matsubara et al. |
| 2009/0182518 | A1 | 7/2009 | Chu et al. |
| 2009/0198350 | A1 | 8/2009 | Thiele |
| 2009/0240480 | A1 | 9/2009 | Baramov |
| 2009/0254202 | A1 | 10/2009 | Pekar et al. |
| 2009/0287320 | A1 | 11/2009 | MacGregor et al. |
| 2009/0312998 | A1 | 12/2009 | Berckmans et al. |
| 2010/0017094 | A1 | 1/2010 | Stewart et al. |
| 2010/0038158 | A1 | 2/2010 | Whitney et al. |
| 2010/0050607 | A1 | 3/2010 | He et al. |
| 2010/0122523 | A1 | 5/2010 | Vosz |
| 2010/0204808 | A1 | 8/2010 | Thiele |
| 2010/0268353 | A1 | 10/2010 | Crisalle et al. |
| 2010/0300070 | A1 | 12/2010 | He et al. |
| 2010/0305719 | A1 | 12/2010 | Pekar et al. |
| 2010/0327090 | A1 | 12/2010 | Havlena et al. |
| 2011/0006025 | A1 | 1/2011 | Schneider et al. |
| 2011/0010073 | A1 | 1/2011 | Stewart et al. |
| 2011/0029235 | A1 | 2/2011 | Berry |
| 2011/0046752 | A1 | 2/2011 | Piche |
| 2011/0060424 | A1 | 3/2011 | Havlena |
| 2011/0066308 | A1 | 3/2011 | Yang et al. |
| 2011/0071653 | A1 | 3/2011 | Kihas |
| 2011/0087420 | A1 | 4/2011 | Stewart et al. |
| 2011/0104015 | A1 | 5/2011 | Boyden et al. |
| 2011/0125293 | A1 | 5/2011 | Havlena |
| 2011/0167025 | A1 | 7/2011 | Danai et al. |
| 2011/0270505 | A1 | 11/2011 | Chaturvedi et al. |
| 2011/0301723 | A1 | 12/2011 | Pekar et al. |
| 2012/0010732 | A1 | 1/2012 | Stewart et al. |

FOREIGN PATENT DOCUMENTS

| | | |
|---|---|---|
| EP | 0301527 | 2/1989 |
| EP | 0950803 | 4/1999 |
| EP | 1134368 | 3/2001 |
| EP | 1180583 | 2/2002 |
| EP | 1221544 | 7/2002 |
| EP | 1245811 | 10/2002 |
| EP | 1686251 | 8/2006 |
| EP | 2107439 | 10/2009 |
| EP | 2146258 | 1/2010 |
| JP | 59190443 | 10/1984 |
| JP | 2010282618 | 12/2010 |
| WO | 0232552 | 4/2002 |
| WO | WO 02/101208 | 12/2002 |
| WO | 03048533 | 6/2003 |
| WO | WO 03/065135 | 8/2003 |
| WO | WO 03/078816 | 9/2003 |
| WO | WO 2004/027230 | 4/2004 |
| WO | 2008033800 | 3/2008 |
| WO | 2008115911 | 9/2008 |

OTHER PUBLICATIONS

Advanced Petroleum-Based Fuels-Diesel Emissions Control (APBF-DEC) Project, "Quarterly Update," No. 7, 6 pages, Fall 2002.

Allanson, et al., "Optimizing the Low Temperature Performance and Regeneration Efficiency of the Continuously Regenerating Diesel Particulate Filter System," SAE Paper No. 2002-01-0428, 8 pages, Mar. 2002.

Amstuz, et al., "EGO Sensor Based Robust Output Control of EGR in Diesel Engines," IEEE TCST, vol. 3, No. 1, 12 pages, Mar. 1995.

Bemporad, et al., "Explicit Model Predictive Control," 1 page, prior to Feb. 2, 2005.

Bertsekas, "On the Goldstein-Levitin-Polyak Gradient Projection Method," IEEE Transactions on Automatic Control, vol. AC-21, No. 2, pp. 174-184, Apr. 1976.

Bertsekas, "Projected Newton Methods for Optimization Problems with Simple Constraints," SIAM J. Control and Ostimization, vol. 20, No. 2, pp. 221-246, Mar. 1982.

Borrelli, "Constrained Optimal Control of Linear and Hybrid Systems," Lecture Notes in Control and Information Sciences, vol. 290, 2003.

Catalytica Energy Systems, "Innovative NOx Reduction Solutions for Diesel Engines," 13 pages, 3rd Quarter, 2003.

Chatterjee, et al. "Catalytic Emission Control for Heavy Duty Diesel Engines," JM, 46 pages, prior to Feb. 2, 2005.

De Schutter et al., "Model Predictive Control for Max-Min-Plus-Scaling Systems," Proceedings of the 2001 American Control Conference, Arlington, Va, pp. 319-324, Jun. 2001.

Delphi, Delphi Diesel NOx Trap (DNT), 3 pages, Feb. 2004.

Diehl et al., "Efficient Numerical Methods for Nonlinear MPC and Moving Horizon Estimation," Int. Workshop on Assessment and Future Directions of NMPC, 24 pages, Pavia, Italy, Sep. 5-9, 2008.

GM "Advanced Diesel Technology and Emissions," powertrain technologies—engines, 2 pages, prior to Feb. 2, 2005.

Guerreiro et al., "Trajectory Tracking Nonlinear Model Predictive Control for Autonomous Surface Craft," Proceedings of the European Control Conference, Budapest, Hungary, 6 pages, Aug. 2009.

Guzzella, et al., "Control of Diesel Engines," IEEE Control Systems Magazine, pp. 53-71, Oct. 1998.

Havelena, "Componentized Architecture for Advanced Process Management," Honeywell International, 42 pages, 2004.

Hiranuma, et al., "Development of DPF System for Commercial Vehicle—Basic Characteristic and Active Regeneration Performance," SAE Paper No. 2003-01-3182, Mar. 2003.

Honeywell, "Profit Optimizer a Distributed Quadratic Program (DQP) Concepts Reference," 48 pages, prior to Feb. 2, 2005.

http://www.not2fast.wryday.com/turbo/glossary/turbo_glossary.shtml, "Not2Fast: Turbo Glossary," 22 pages, printed Oct. 1, 2004.

http://www.tai-cwv.com/sb1106.0.html, "Technical Overview—Advanced Control Solutions," 6 pages, printed Sep. 9, 2004.

Jonsson, "Fuel Optimized Predictive Following in Low Speed Conditions," Master's Thesis, 46 pages, Jun. 28, 2003.

Kelly, et al., "Reducing Soot Emissions from Diesel Engines Using One Atmosphere Uniform Glow Discharge Plasma," SAE Paper No. 2003-01-1183, Mar. 2003.

Kolmanovsky, et al., "Issues in Modeling and Control of Intake Flow in Variable Geometry Turbocharged Engines", 18th IFIP Conf. System Modeling and Optimization, pp. 436-445, Jul. 1997.

Kulhavy, et al. "Emerging Technologies for Enterprise Optimization in the Process Industries," Honeywell, 12 pages, Dec. 2000.

Locker, et al., "Diesel Particulate Filter Operational Characterization," Corning Incorporated, 10 pages, prior to Feb. 2, 2005.

Lu, "Challenging Control Problems and Engineering Technologies in Enterprise Optimization," Honeywell Hi-Spec Solutions, 30 pages, Jun. 4-6, 2001.

Mehta, "The Application of Model Predictive Control to Active Automotive Suspensions," 56 pages, May 17, 1996.

Moore, "Living with Cooled-EGR Engines," Prevention Illustrated, 3 pages, Oct. 3, 2004.

Murayama et al., "Speed Control of Vehicles with Variable Valve Lift Engine by Nonlinear MPC," ICROS-SICE International Joint Conference, pp. 4128-4133, 2009.

National Renewable Energy Laboratory (NREL), "Diesel Emissions Control-Sulfur Effects Project (DECSE) Summary of Reports," U.S. Department of Energy, 19 pages, Feb. 2002.

Salvat, et al., "Passenger Car Serial Application of a Particulate Filter System on a Common Rail Direct Injection Engine," SAE Paper No. 2000-01-0473, 14 pages, Feb. 2000.
Shamma, et al. "Approximate Set-Valued Observers for Nonlinear Systems," IEEE Transactions on Automatic Control, vol. 42, No. 5, May 1997.
Soltis, "Current Status of NOx Sensor Development," Workshop on Sensor Needs and Requirements for PEM Fuel Cell Systems and Direct-Injection Engines, 9 pages, Jan. 25-26, 2000.
Stefanopoulou, et al., "Control of Variable Geometry Turbocharged Diesel Engines for Reduced Emissions," IEEE Transactions on Control Systems Technology, vol. 8, No. 4, pp. 733-745, Jul. 2000.
Storset, et al., "Air Charge Estimation for Turbocharged Diesel Engines," vol. 1 Proceedings of the American Control Conference, 8 pages, Jun. 28-30, 2000.
The MathWorks, "Model-Based Calibration Toolbox 2.1 Calibrate complex powertrain systems," 4 pages, prior to Feb. 2, 2005.
The MathWorks, "Model-Based Calibration Toolbox 2.1.2," 2 pages, prior to Feb. 2, 2005.
Theiss, "Advanced Reciprocating Engine System (ARES) Activities at the Oak Ridge National Lab (ORNL), Oak Ridge National Laboratory," U.S. Department of Energy, 13 pages, Apr. 14, 2004.
Van Basshuysen et al., "Lexikon Motorentechnik," (Dictionary of Automotive Technology) published by Vieweg Verlag, Wiesbaden 039936, p. 518, 2004. (English Translation).
Van Den Boom et al., "MPC for Max-Plus-Linear Systems: Closed-Loop Behavior and Tuning," Proceedings of the 2001 American Control Conference, Arlington, Va, pp. 325-330, Jun. 2001.
Van Keulen et al., "Predictive Cruise Control in Hybrid Electric Vehicles," World Electric Vehicle Journal vol. 3, ISSN 2032-6653, pp. 1-11, 2009.
Wang et al., "Fast Model Predictive Control Using Online Optimization," Proceedings of the 17th World Congress, the International Federation of Automatic Control, Seoul, Korea, pp. 6974-6979, Jul. 6-11, 2008.
Wang et al., "PSO-Based Model Predictive Control for Nonlinear Processes," Advances in Natural Computation, Lecture Notes in Computer Science, vol. 3611/2005, 8 pages, 2005.
Zavala et al., "The Advance-Step NMPC Controller: Optimality, Stability, and Robustness," Automatica, vol. 45, pp. 86-93, 2009.
Zeilinger et al., "Real-Time MPC—Stability Through Robust MPC Design," Joint 48th IEEE Conference on Decision and Control and 28th Chinese Control Conference, Shanghai, P.R. China, pp. 3980-3986, Dec. 16-18, 2009.
Zenlenka, et al., "An Active Regeneration as a Key Element for Safe Particulate Trap Use," SAE Paper No. 2001-0103199, 13 pages, Feb. 2001.
Zhu, "Constrained Nonlinear Model Predictive Control for Vehicle Regulation," Dissertation, Graduate School of the Ohio State University, 125 pages, 2008.
"Model Predictive Control Toolbox Release Notes," The Mathworks, 24 pages, Oct. 2008.
"MPC Implementation Methods for the Optimization of the Response of Control Valves to Reduce Variability," Advanced Application Note 002, Rev. A, 10 pages, 2007.
Bemporad et al., "Model Predictive Control Toolbox 3, User's Guide," Matlab Mathworks, 282 pages, 2008.
Bemporad et al., "The Explicit Linear Quadratic Regulator for Constrained Systems," Automatica, 38, pp. 3-20, 2002.
Bemporad, "Model Predictive Control Based on Linear Programming—The Explicit Solution," IEEE Transactions on Automatic Control, vol. 47, No. 12, pp. 1974-1984, Dec. 2002.
Bemporad, "Model Predictive Control Design: New Trends and Tools," Proceedings of the 45th IEEE Conference on Decision & Control, pp. 6678-6683, Dec. 13-15, 2006.
Boom et al., "MPC for Max-Plus-Linear Systems: Closed-Loop Behavior and Tuning", Jun. 2001, Proceedings of the 2001 American Control Conference, Arlington, VA, pp. 325-300.
Borrelli et al., "An MPC/Hybrid System Approach to Traction Control," IEEE Transactions on Control Systems Technology, vol. 14, No. 3, pp. 541-553, May 2006.
Borrelli, "Discrete Time Constrained Optimal Control," A Dissertation Submitted to the Swiss Federal Institute of Technology (ETH) Zurich, Diss. ETH No. 14666, 232 pages, Oct. 9, 2002.
Bunting, "Increased Urea Dosing Could Cut SCR Truck Running Costs", http://www.automotiveworld.com/article/85897-increased-urea-dosing-could-cut-scr-truck-running-costs, Automotive World, 3 pages, Feb. 24, 2011, printed Mar. 2, 2011.
International Application Status Report for WO 2008/033800.
U.S. Appl. No. 13/236,217.
U.S. Appl. No. 13/290,012.
Johansen et al., "Hardware Architecture Design for Explicit Model Predictive Control," Proceedings of ACC, 6 pages, 2006.
Johansen et al., "Hardware Synthesis of Explicit Model Predictive Controllers," IEEE Transactions on Control Systems Technology, vol. 15, No. 1, Jan. 2007.
Keulen et al., "Predictive Cruise Control in Hybrid Electric Vehicles", May 2009, World Electric Journal, vol. 3, ISSN 2032-6653.
Maciejowski, "Predictive Control with Constraints," Prentice Hall, Pearson Education Limited, 4 pages, 2002.
Mariethoz et al., "Sensorless Explicit Model Predictive Control of the DC-DC Buck Converter with Inductor Current Limitation," IEEE Applied Power Electronics Conference and Exposition, pp. 1710-1715, 2008.
Marjanovic, "Towards a Simplified Infinite Horizon Model Predictive Controller," 6 pages, Proceedings of the 5th Asian Control Conference, 6 pages, Jul. 20-23, 2004.
Mayne et al., "Constrained Model Predictive Control: Stability and Optimality," Automatica, vol. 36, pp. 789-814, 2000.
Ortner et al., "MPC for a Diesel Engine Air Path Using an Explicit Approach for Constraint Systems," Proceedings of the 2006 IEEE Conference on Control Applications, Munich Germany, pp. 2760-2765, Oct. 4-6, 2006.
Ortner et al., "Predictive Control of a Diesel Engine Air Path," IEEE Transactions on Control Systems Technology, vol. 15, No. 3, pp. 449-456, May 2007.
Pannocchia et al., "Combined Design of Disturbance Model and Observer for Offset-Free Model Predictive Control," IEEE Transactions on Automatic Control, vol. 52, No. 6, 6 pages, 2007.
Qin et al., "A Survey of Industrial Model Predictive Control Technology," Control Engineering Practice, 11, pp. 733-764, 2003.
Rawlings, "Tutorial Overview of Model Predictive Control," IEEE Control Systems Magazine, pp. 38-52, Jun. 2000.
Schauffele et al., "Automotive Software Engineering Principles, Processes, Methods, and Tools," SAE International, 10 pages, 2005.
Schutter et al., "Model Predictive Control for Max-Min-Plus-Scaling Systems", Jun. 2001, Proceedings of the 2001 American Control Conference, Arlington, VA, pp. 319-324.
Stewart et al., "A Model Predictive Control Framework for Industrial Turbodiesel Engine Control," Proceedings of the 47th IEEE Conference on Decision and Control, 8 pages, 2008.
Stewart et al., "A Modular Model Predictive Controller for Turbodiesel Problems," First Workshop on Automotive Model Predictive Control, Schloss Muhldorf, Feldkirchen, Johannes Kepler University, Linz, 3 pages, 2009.
Tondel et al., "An Algorithm for Multi-Parametric Quadratic Programming and Explicit MPC Solutions," Automatica, 39, pp. 489-497, 2003.

* cited by examiner

ENGINE CONTROLLER

This application is a continuation of U.S. application Ser. No. 12/973,704, filed Dec. 20, 2010, entitled, "ENGINE CONTROLLER", which is a continuation of U.S. application Ser. No. 12/144,445 filed Jun. 23, 2008, entitled, "EMISSIONS SENSORS FOR FUEL CONTROL IN ENGINES", now U.S. Pat. No. 7,878,178, which is a continuation of U.S. application Ser. No. 11/206,404 filed Aug. 18, 2005, entitled, "EMISSIONS SENSORS FOR FUEL CONTROL IN ENGINES", now U.S. Pat. No. 7,389,773.

BACKGROUND

The present invention pertains to engines and particularly to fuel control for internal combustion engines. More particularly, the invention pertains to fuel control based on contents of engine exhaust.

SUMMARY

The present invention includes fuel control of an engine based on emissions in the exhaust gases of the engine.

DESCRIPTION

Figure 1:
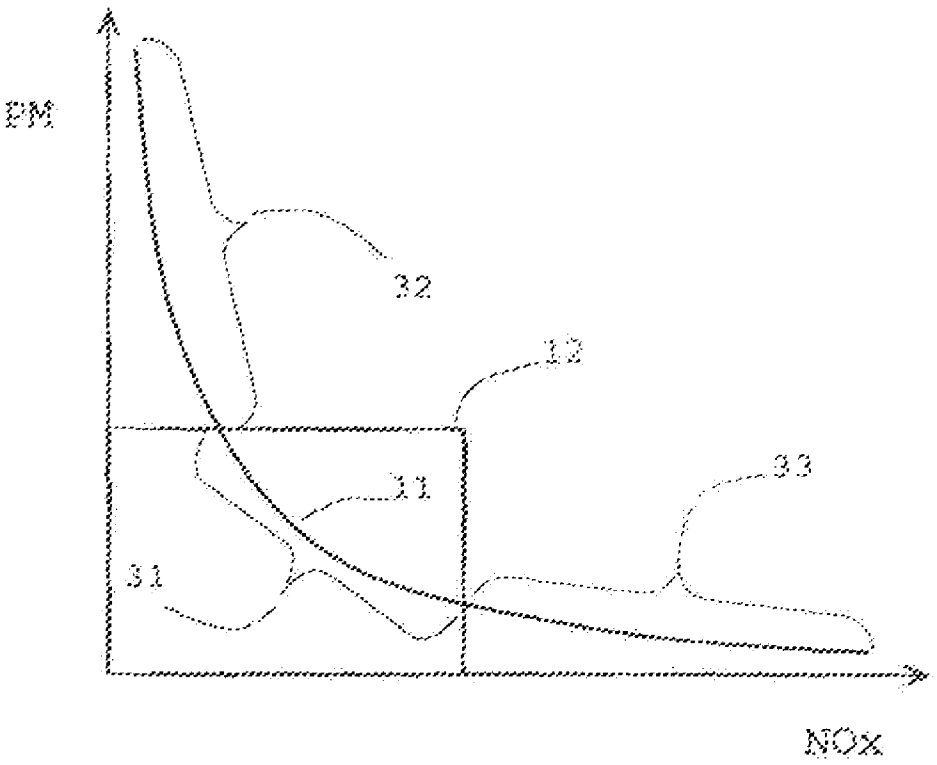
FIG. 1 is a chart showing the standard diesel engine tradeoff between particulate matter and nitrogen oxide emissions of an engine.

Engines often use catalytic converters and oxygen sensors to help control engine emissions. A driver-commanded pedal is typically connected to a throttle that meters air into engine. That is, stepping on the pedal directly opens the throttle to allow more air into the engine. Oxygen sensors are often used to measure the oxygen level of the engine exhaust, and provide feed back to a fuel injector control to maintain the desired air/fuel ratio (AFR), typically close to a stoichiometric air-fuel ratio to achieve stoichiometric combustion. Stoichiometric combustion can allow three-way catalysts to simultaneously remove hydrocarbons, carbon monoxide, and oxides of nitrogen (NOx) in attempt to meet emission requirements for the spark ignition engines.

Compression ignition engines (e.g., diesel engines) have been steadily growing in popularity. Once reserved for the commercial vehicle markets, diesel engines are now making real headway into the car and light truck markets. Partly because of this, federal regulations were passed requiring decreased emissions in diesel engines.

Many diesel engines now employ turbochargers for increased efficiency. In such systems, and unlike most spark ignition engines, the pedal is not directly connected to a throttle that meters air into engine. Instead, a pedal position is used to control the fuel rate provided to the engine by adjusting a fuel "rack", which allows more or less fuel per fuel pump shot. The air to the engine is typically controlled by the turbocharger, often a variable nozzle turbocharger (VNT) or waste-gate turbocharger.

Traditional diesel engines can suffer from a mismatch between the air and fuel that is provided to the engine, particularly since there is often a time delay between when the operator moves the pedal, i.e., injecting more fuel, and when the turbocharger spins-up to provide the additional air required to produced the desired air-fuel ratio. To shorten this "turbo-lag", a pedal position sensor (fuel rate sensor) may be added and fed back to the turbocharger controller to increase the natural turbo acceleration, and consequently the air flow to the engine which may for example set the vane positions of a VNT turbocharger.

The pedal position is often used as an input to a static map, the output of which is in turn used as a setpoint in the fuel injector control loop which may compare the engine speed setpoint to the measured engine speed. Stepping on the pedal increases the engine speed setpoint in a manner dictated by the static map. In some cases, the diesel engine contains an air-fuel ratio (AFR) estimator, which is based on input parameters such as fuel injector flow and intake manifold air flow, to estimate when the AFR is low enough to expect smoke to appear in the exhaust, at which point the fuel flow is reduced. The airflow is often managed by the turbocharger, which provides an intake manifold pressure and an intake manifold flow rate for each driving condition.

In diesel engines, there are typically no sensors in the exhaust stream analogous to the oxygen sensors found in spark ignition engines. Thus, control over the combustion is often performed in an "open-loop" manner, which often relies on engine maps to generate set points for the intake manifold parameters that are favorable for acceptable exhaust emissions. As such, engine air-side control is often an important part of overall engine performance and in meeting exhaust emission requirements. In many cases, control of the turbocharger and EGR systems are the primary components in controlling the emission levels of a diesel engine.

Diesel automotive emissions standards today and in the future may be partly stated in terms of particulate matter (soot) and nitrogen oxides (NOx). Direct measurement feedback on the true soot measurement may have significant advantages over an air-fuel ratio (AFR) in the related art. The present system may enable one to read the soot directly rather than using an (unreliable) AFR estimation to infer potential smoke. Particulate matter (PM) and NOx sensor readings may be used for fuel injection control in diesel engines. The NOx and PM may both be regulated emissions for diesel engines. Reduction of both NOx and PM would be favorable. There may be a fundamental tradeoff between NOx and PM such that for most changes made to a diesel engine, reducing the engine-out PM is typically accompanied by an increase in engine-out NOx and vice versa. In FIG. 1, the abscissa indicates a magnitude of PM and the ordinate indicates a magnitude of NOx in an engine exhaust gas. An engine's PM and NOx emissions may be indicated with a curve 11. An area 12 represents the maximum emissions for an engine exhaust gas. A PM sensor may be good for characterizing the PM part of the curve 11 (typically associated with a rich combustion, high exhaust gas recirculation (EGR) rates, or otherwise). A NOx sensor may be well suited to characterize the "other extreme" of curve 11 representing a diesel engine combustion (typically associated with lean, hot burn, low EGR, and the like). The present invention may incorporate the notion that a diesel emissions control problem requires both ends of the diesel combustion to be covered by emissions sensing. NOx and PM sensors may give information that is synthesized into an understanding of the diesel combustion. This is important since both NOx and PM are increasingly tightly legislated emissions in many countries.

Some fuel injection handles or parameters may have certain impacts on NOx and PM emissions. Examples may include an early start of the injection which may result in good brake specific fuel consumption (bsfc), low PM and high NOx. High rail pressure may result in increased NOx, low PM and slightly improved fuel consumption. A lean air-fuel ratio (AFR), achieved by reducing the total fuel quantity, may result in increased NOx and decreased PM. A rich air-fuel ratio (AFR) achieved by changing the total fuel quantity may result in decreased NOx and increased PM.

Figure 3:
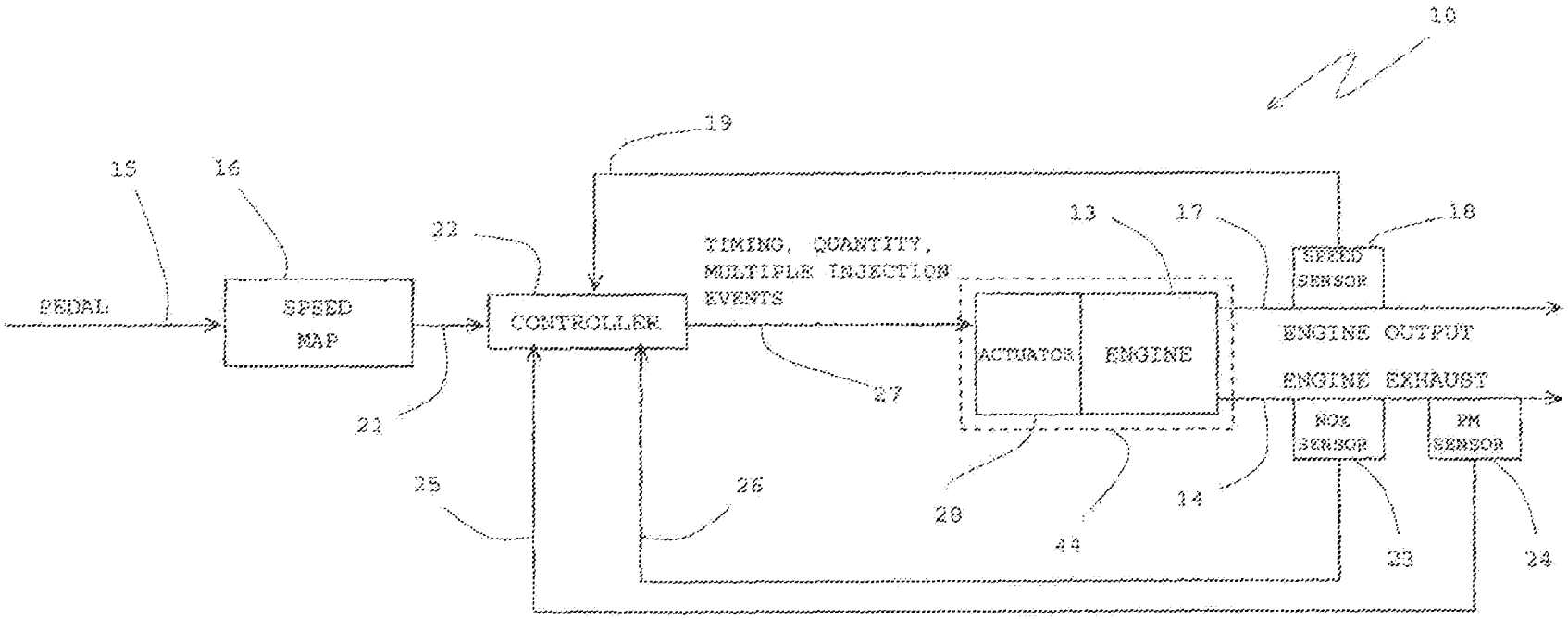
FIG. 3 is a diagram of an emission sensing and control system for engine fuel control.

FIG. 3 shows a fuel control system 10 for engine 13 based at least partially on engine exhaust 14 emissions. A pedal input 15 may be connected to a speed map 16 for controlling the speed of engine 13 output that may be used for driving a vehicle or some other mechanism. The speed of the engine output 17 may be detected by a speed sensor 18. Sensor 18 may provide an indication 19 of the speed to the speed map 16. The speed map 16 may combine the pedal signal 15 and the speed signal 19 to provide a fuel control signal 21 to a fuel rate limiter, fuel controller or other controller 22.

An NOx sensor 23, situated in exhaust 14, may provide a signal 25 indicating an amount of NOx sensed in exhaust 14. A PM sensor 24 may be situated in the exhaust 14 and provide a signal 26 indicating an amount of PM sensed in exhaust 14. The controller 22 may process signals 21, 25 and 26 into an output signal 27 to an actuator 28, such as a fuel injector and/or other actuator, of engine 13. Signal 27 may contain information relating to engine 13 control such as timing of fuel provisions, quantities of fuel, multiple injection events, and so forth. Signal 27 may go to an engine control unit 26, which in turn may sense and control various parameters of engine 11 for appropriate operation. Other emissions sensors, such as SOx sensors, may be utilized in the present system 10 for fuel control, emissions control, engine control, and so forth.

Figure 2:
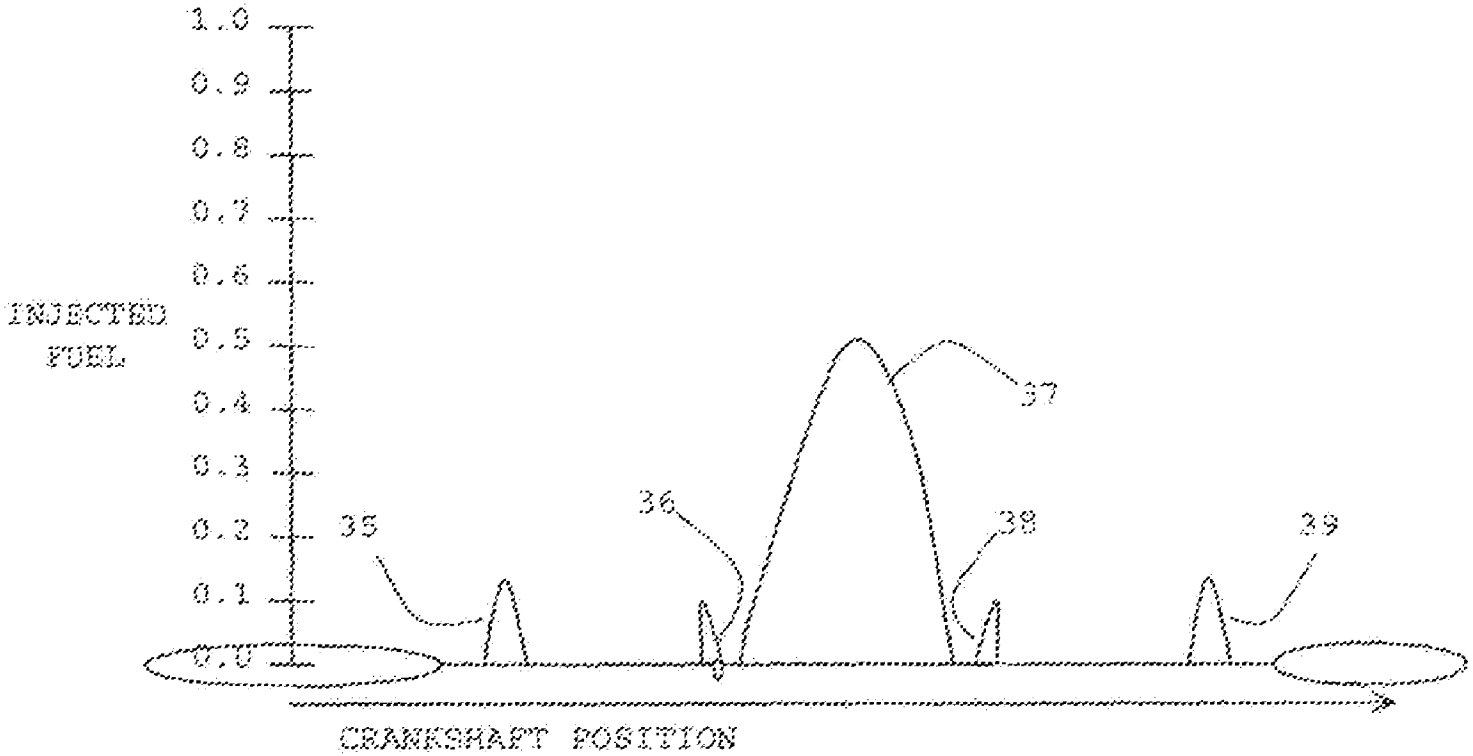
FIG. 2 is a graph of fuel injector events and the magnitudes reflecting some injection rate control for an engine.

Fuel injection systems may be designed to provide injection events, such as the pre-event 35, pilot event 36, main event 37, after event 38 and post event 39, in that order of time, as shown in the graph of injection rate control in FIG. 2. After-injection and post-injection events 38 and 39 do not contribute to the power developed by the engine, and may be used judiciously to simply heat the exhaust and use up excess oxygen. The pre-catalyst may be a significant part of the present process because all of the combustion does not take place in the cylinder.

In FIG. 3, signals 25 and 26 may indicate NOx and PM amounts in exhaust 14 to the fuel rate limiter, fuel controller or controller 22. The controller 22 may attempt to adjust or control fuel injection or supply, and/or other parameter, to the engine 13 so as to control or limit the NOx and PM emissions in the exhaust 14. The emissions may be maintained as represented by a portion 31 of the curve 11 in FIG. 1. The tradeoff between NOx and PM typically means that a reduction in PM may be accompanied by an increase in NOx and vice versa. The PM sensor 24 may be relied on for information at portion 32 of curve 11. The NOx sensor 23 may be relied on for sensing information at portion 33 of curve 11. Both sensors 23 and 24 may provide information in combination for attaining an emissions output of the exhaust 14 in the portion 31 of curve 11.

The PM sensor 24 may appropriately characterize the PM portion 32 of the curve 11 which typically may be associated for example with a rich combustion or a high exhaust recirculation rate. The NOx sensor 23 may be better suited to characterize the other extreme of the combustion which typically may be associated for example with a lean or hot burn and a low exhaust combustion rate.

In some cases, the controller 22 may be a multivariable model predictive Controller (MPC). The MPC may include a model of the dynamic process of engine operation, and provide predictive control signals to the engine subject to constraints in control variables and measured output variables. The models may be static and/or dynamic, depending on the application. In some cases, the models may produce one or more output signals y(t) from one or more input signals u(t). A dynamic model typically contains a static model plus information about the time response of the system. Thus, a dynamic model is often of higher fidelity than a static model.

In mathematical terms, a linear dynamic model has the form:

$$y(t)=B0*u(t)+B1*u(t-1)+\ldots+Bn*u(t-n)+A1*y(t-1)+\ldots+Am*y(t-m)$$

where B0 . . . Bn, and A1 . . . Am are constant matrices. In a dynamic model, y(t) which is the output at time t, may be based on the current input u(t), one or more past inputs u (t−1), . . . , u(t−n), and also on one or more past outputs y (t−1) . . . y(t−m).

A static model may be a special case where the matrices B1= . . . =Bn=0, and A1= . . . =Am=0, which is given by the simpler relationship:

$$y(t)=B0u(t)$$

A static model as shown is a simple matrix multiplier. A static model typically has no "memory" of the inputs u(t−1), u (t−2) . . . or outputs y(t−1) . . . and the like. As a result, a static model can be simpler, but may be less powerful in modeling some dynamic system parameters.

For a turbocharged diesel system, the system dynamics can be relatively complicated and several of the interactions may have characteristics known as "non-minimum phase". This is a dynamic response where the output y(t), when exposed to a step in input u(t), may initially move in one direction, and then turn around and move towards its steady state in the opposite direction. The soot (PM) emission in a diesel engine is just one example. In some cases, these dynamics may be important for optimal operation of the control system. Thus, dynamic models are often used, at least when modeling some control parameters.

In one example, the MPC may include a multivariable model that models the effect of changes in one or more actuators of the engine (e.g., fueling rate, and the like) on each of one or more parameters (e.g., engine speed 19, NOx 26, PM 25), and the multivariable controller may then control the actuators to produce a desired response in the two or more parameters. Likewise, the model may, in some cases, model the effects of simultaneous changes in two or more actuators on each of one or more engine parameters, and the multivariable controller may control the actuators to produce a desired response in each of the one or more parameters.

For example, an illustrative state-space model of a discrete time dynamical system may be represented using equations of the form:

$$x(t+1)=Ax(t)+Bu(t)$$

$$y(t)=Cx(t)$$

The model predictive algorithm involves solving the problem:

$$u(k)=\arg\min\{J\}$$

Where the function J is given by, $$J = \hat{x}(t+N_y \mid t)^T P\hat{x}(t+N_y \mid t) + \sum_{k=0}^{N_y-1} [\hat{x}(t+k \mid t)^T Q\hat{x}(t+k \mid t) + u(t+k)^T Ru(t+k)]$$

Subject to Constraints $$y_{min} \leqq \hat{y}(t+k|t) \leqq y_{max}$$

$$u_{min} \leqq u(t+k) \leqq u_{max}$$

$$x(t|t)=x(t)$$

$$\hat{x}(t+k°1|t)=A\hat{x}(t+k|t)+Bu(t+k)$$

$$\hat{y}(t+k|t)=C\hat{x}(t+k|t)$$

In some examples, this is transformed into a quadratic programming (QP) problem and solved with standard or customized tools.

The variable "y(k)" may contain the sensor measurements (for the turbocharger problem, these include but are not limited to engine speed, NOx emissions, PM emissions, and so forth). The variables $\hat{y}(k+t|t)$ denote the outputs of the system predicted at time "t+k" when the measurements "y(t)" are available. They may be used in the model predictive controller to choose the sequence of inputs which yields the "best" (according to performance index J) predicted sequence of outputs.

The variables "u(k)" are produced by optimizing J and, in some cases, are used for the actuator set points. For the fuel controller problem these signals 27 may include, but are not limited to, the timing, quantity, multiple injection events, and so forth. The variable "x(k)" is a variable representing an internal state of the dynamical state space model of the system. The variable $\hat{x}(t+k|t)$ indicates the predicted version of the state variable k discrete time steps into the future and may be used in the model predictive controller to optimize the future values of the system.

The variables ymin and ymax are constraints and may indicate the minimum and maximum values that the system predicted measurements $\hat{y}(k)$ are permitted to attain. These often correspond to hard limits on the closed-loop behavior in the control system. For example, a hard limit may be placed on the PM emissions such that they are not permitted to exceed a certain number of grams per second at some given time. In some cases, only a minimum ymin or maximum ymax constraint is provided. For example, a maximum PM emission constraint may be provided, while a minimum PM emission constraint may be unnecessary or undesirable.

The variables umin and umax are also constraints, and indicate the minimum and maximum values that the system actuators $\hat{u}(k)$ are permitted to attain, often corresponding to physical limitations on the actuators. For example, the fuel quantity may have a minimum value and a maximum value corresponding to the maximum fuel rate achievable by the actuator. Like above, in some cases and depending on the circumstances, only a minimum umin or maximum umax constraint may be provided. Also, some or all of the constraints (e.g. ymin, ymax, umin, umax) may vary in time, depending on the current operating conditions. The state and actuator constraints may be provided to the controller 22 via an interface.

The constant matrices P, Q, R are often positive definite matrices used to set a penalty on the optimization of the respective variables. These may be used in practice to "tune" the closed-loop response of the system.

Figure 4:
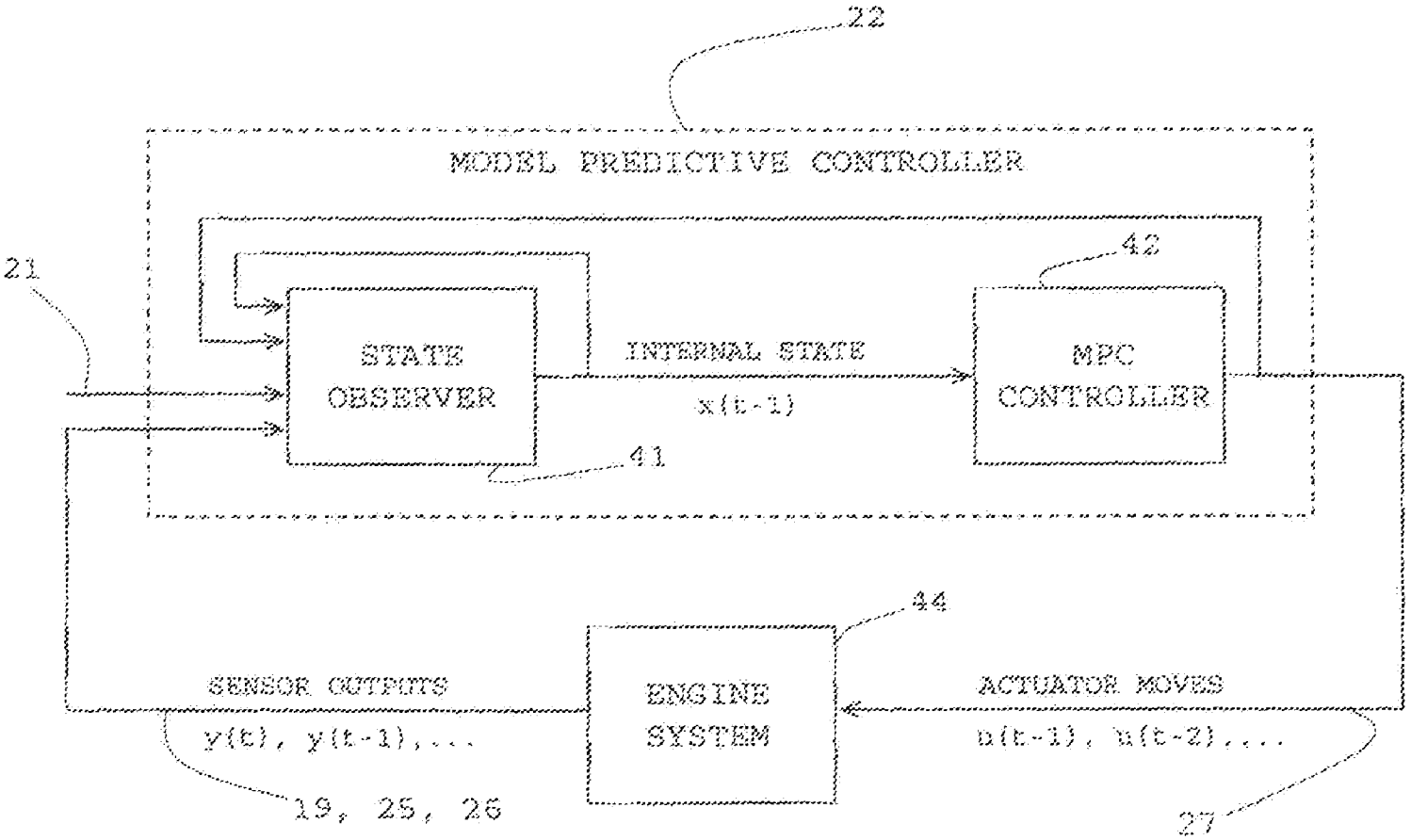
FIG. 4 is a schematic view of an illustrative model predictive controller.

FIG. 4 is a schematic view of an illustrative model predictive controller. In this example, the MPC 22 may include a state observer 41 and a MPC controller 42. The MPC Controller 84 provides a number of control outputs "u" to actuators or the like of the engine 13. Illustrative control outputs 27 include, for example, the timing, quantity, multiple injection events, and so forth. The MPC controller may include a memory for storing past values of the control outputs u(t), u(t−1), u(t−2), and the like.

The state observer 41 may receive a number of inputs "y", a number of control outputs "u", and a number of internal variables "x". Illustrative inputs "y" include, for example, the engine speed signal 19, the NOx sensor 23 output 26, and/or the PM sensor 24 output 25. It is contemplated that the inputs "y" may be interrogated constantly, intermittently, or periodically, or at any other time, as desired. Also, these input parameters are only illustrative, and it is contemplated that more or less input signals may be provided, depending on the application. In some cases, the state observer may receive present and/or past values for each of the number of inputs "y", the number of control outputs "u", and a number of internal state variables "x", depending on the application.

The state observer 41 may produce a current set of state variables "x", which are then provided to the MPC controller 42. The MPC controller 42 may then calculate new control outputs "u", which are presented to actuators or the like on the engine 13. The control outputs "u" may be updated constantly, intermittently, or periodically, or at any other time, as desired. The engine system 44 may operate using the new control outputs "u", and produces new inputs "y".

In one illustrative example, the MPC 22 may be programmed using standard quadratic programming (QP) and/or linear programming (LP) techniques to predict values for the control outputs "u" so that the engine system 44 produces inputs "y" that are at a desired target value, within a desired target range, and/or do not violate any predefined constraints. For example, by knowing the impact of the fuel quantity and timing, on the engine speed, NOx and/or PM emissions, the MPC 22 may predict values for the control outputs 27 fuel quantity and timing so that future values of the engine speed 19, NOx 24 and/or PM 23 emissions are at or remain at a desired target value, within a desired target range, and/or do not violate current constraints.

The MPC 22 may be implemented in the form of online optimization and/or by using equivalent lookup tables computed with a hybrid multi-parametric algorithm. Hybrid multi-parametric algorithms may allow constraints on emission parameters as well as multiple system operating modes to be encoded into a lookup table which can be implemented in an engine control unit (ECU) of an engine. The emission constraints may be time-varying signals which enter the lookup table as additional parameters. Hybrid multi-parametric algorithms are further described by F. Borrelli in "Constrained Optimal Control of Linear and Hybrid Systems", volume 290 of Lecture Notes in Control and Information Sciences, Springer, 2003, which is incorporated herein by reference.

Alternatively, or in addition, the MPC 22 may include one or more proportional-integral-derivative (PID) control loops, one or more predictive constrained control loops—such as a Smith predictor control loop, one or more multiparametric control loops, one or more multivariable control loops, one or more dynamic matrix control loops, one or more statistical processes control loop, a knowledge based expert system, a neural network, fuzzy logic or any other suitable control mechanism, as desired. Also, the MPC may provide commands and/or set points for lower-level controllers that are used to control the actuators of the engine. In some cases, the lower level controllers may be, for example, single-input-single-output (SISO) controllers such as PID controllers.

Figure 5:
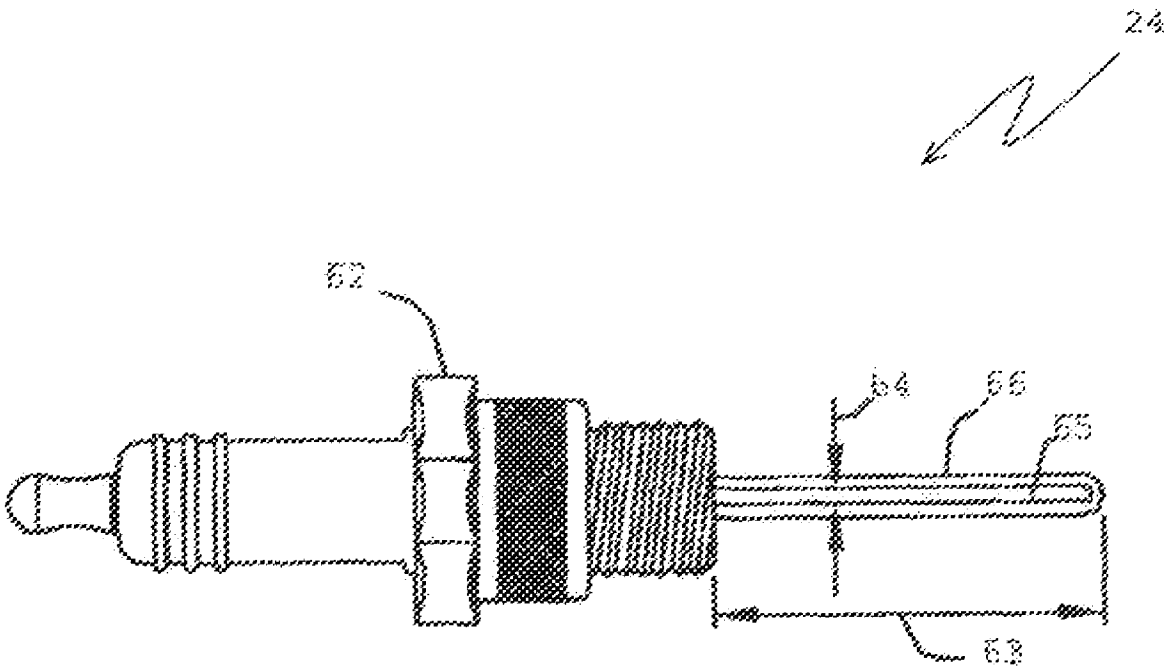
FIG. 5 shows a particulate matter sensor.

The PM sensor 24 may have a spark-plug-like support 62 as shown in FIG. 5. The PM sensor may provide an output based on the PM formed on the probe. The sensor or probe may be placed in a path of the exhaust of the engine 13. The length 63 and diameter 64 of a probe electrode 65 may vary depending on the parameters of the sensing electronics and the engine. The probe electrode 65 may be passivated with a very thin conductive coating or layer 66 on it. This coating or layer 66 may prevent electrical shorting by the soot layer accumulated by the probe during the operation of engine 13. The passivation material 66 may be composed of SiN4, cerium or other oxide, and/or the like. The thickness of the passivation layer 66 on the probe electrode 65 may be between 0.001 and 0.020 inch. A nominal thickness may be about 0.01 inch. The passivation layer 66 may be achieved with the probe electrode 65 exposed to high exhaust temperatures or may be coated with a layer via a material added to the engine's fuel.

Sensor or probe 24 may have various dimensions. Examples of an electrode 65 length dimension 63 may be between 0.25 and 12 inches. A nominal value of the length 63 may be about 3 to 4 inches. Examples of a thickness or diameter dimension 64 may be between 1/32 inch and 3/8 inch. A nominal thickness may be about 1/8 inch.

An example of the probe may include a standard spark plug housing 62 that has the outside or ground electrode removed and has a 4 to 6 inch metal extension of about 1/8 inch thickness or diameter welded to a center electrode. The sensor 24 may be mounted in the exhaust stream near an exhaust manifold or after a turbocharger, if there is one, of the engine 13. The sensing electrode 65 may be connected to an analog charge amplifier of a processing electronics. The charge transients from the electrode 65 of probe 24 may be directly proportional to the soot (particulate) concentration in the exhaust stream. The extended electrode 65 may be passivated with a very thin non-conducting layer 66 on the surface of the electrode 65 exposed to the exhaust gas of the engine 13. For an illustrative example, a 304 type stainless steel may grow the passivating layer 66 on the probe electrode 65 spontaneously after a few minutes of operation in the exhaust stream at temperatures greater than 400 degrees C. (750 degrees F.). However, a passivating layer 66 of cerium oxide may instead be grown on the probe electrode 65 situated in the exhaust, by adding an organometallic cerium compound (about 100 PPM) to the fuel for the engine 13.

Other approaches of passivating the probe or electrode 65 with a layer 66 may include sputter depositing refractory ceramic materials or growing oxide layers in controlled environments. Again, the purpose of growing or depositing the passivating layer 66 on electrode 65 situated in the exhaust is to prevent shorts between the electrode and the base of the spark-plug like holder 62 due to PM buildups, so that sensor or probe 24 may retain its image charge monitoring activity of the exhaust stream. If the electrode 65 did not have the passivating layer 66 on it, probe 24 may fail after a brief operating period because of an electrical shorting of the electrode 65 to the support base 62 of the sensor due to a build-up of soot or PM on the electrode.

In summary, the controller may have one or more look-up tables (e.g., incorporating a multi-parametric hybrid algorithm), time-varying emission control restraints, proportional-integral-derivative (ND) control loops, predictive constrained control loops (e.g., including a Smith predictor), multi-parametric control loops, model-based predictive control loops, dynamic matrix control loops, statistical processes control loops, knowledge-based expert systems, neural networks, and/or fuzzy logic schemes.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. An engine controller for controlling at least part of an engine of a vehicle, the engine controller comprising:

two or more inputs for receiving two or more different sensor input signals from two or more different engine sensors;

one or more outputs for providing one or more control signals to one or more actuators that control one or more inputs to the engine, wherein each of the one or more inputs to the engine has an effect on the two or more sensor input signals from the two or more engine sensors; and a controller configured to receive the two or more different sensor input signals from the two or more different engine sensors and to provide the one or more control signals to the one or more actuators via the one or more outputs, the controller configured to adjust the one or more actuators of the engine to achieve a predicted response in each of the two or more different sensor input signals such that a performance index that references the predicted response of each of the two or more different sensor input signals is optimized.

2. The engine controller of claim 1, wherein the controller is configured to adjust the one or more actuators of the engine to achieve the predicted response in each of the two or more sensor input signals using a multi-parameter model, wherein the multi-parameter model models the effects of changes in the one or more actuators on each of the two or more sensor input signals.

3. The engine controller of claim 1, wherein:

the two or more sensor input signals from the two or more engine sensors includes an engine emission sensor input signal; and the one or more control signals effecting a change in one or more fuel properties of a fuel injection event.

4. The engine controller of claim 3, wherein the one or more fuel properties that are affected by the one or more control signals include a fuel injection quantity.

5. The engine controller of claim 3, wherein the one or more fuel properties that are affected by the one or more control signals include a fuel injection event start time.

6. The engine controller of claim 3, wherein the one or more fuel properties that are affected by the one or more control signals include a post fuel injection event start time.

7. The engine controller of claim 3, wherein the one or more fuel properties that are affected by the one or more control signals include a pre fuel injection event start time.

8. The engine controller of claim 3, wherein the one or more fuel properties that are affected by the one or more control signals include a pilot fuel injection event start time.

9. The engine controller of claim 3, wherein the one or more fuel properties that are affected by the one or more control signals include an after fuel injection event start time.

10. The engine controller of claim 3, wherein one of the one or more fuel properties that are affected by the one or more control signals is a fuel rail pressure.

11. The engine controller of claim 1, wherein the controller includes one or more predictive control loops.

12. The engine controller of claim 11, wherein the one or more predictive control loops include one or more constraints.

13. An engine controller for controlling at least part of an engine of a vehicle, the engine controller comprising:

one or more inputs for receiving one or more sensor input signals from one or more engine sensors, wherein at least one of the one or more sensor input signals includes an engine emission sensor input signal from an engine emissions sensor;

one or more outputs for providing one or more control signals to the engine to control one or more inputs to the engine, wherein each of the one or more inputs to the engine has an effect on each of the one or more sensor input signals, including the at least one engine emission sensor input signal; and a controller configured to receive the one or more sensor input signals from the one or more engine sensors and to provide the one or more control signals via the one or more outputs to effect a change in one or more fuel properties of a fuel injection event of the engine to achieve a predicted response in one or more of the sensor input signals and the engine emission sensor input signal, wherein a predicted response of the one or more control signals on the engine emission sensor input signal is opposite in sign to a predicted response of the one or more control signals on a different one of the one or more sensor input signals.

14. The engine controller of claim 13, wherein the one or more fuel properties that are affected by the one or more control signals include a fuel injection quantity.

15. The engine controller of claim 13, wherein the one or more fuel properties that are affected by the one or more control signals include a fuel injection event start time.

16. The engine controller of claim 13, wherein the one or more fuel properties that are affected by the one or more control signals include a post fuel injection event start time.

17. The engine controller of claim 13, wherein one of the one or more fuel properties that are affected by the one or more control signals is a fuel rail pressure.

18. An apparatus, comprising:

a memory storing a control algorithm for an engine controller, the control algorithm comprising:

two or more input parameters for representing two or more engine sensor input signals;

one or more output parameters for representing one or more control signals, the one or more control signals for controlling one or more actuators of an engine that control one or more inputs to the engine, wherein each of the one or more inputs to the engine has an effect on each of the two or more engine sensor input signals; and a model configured to receive the two or more sensor input parameters and to provide the one or more output parameters, wherein the output parameters are configured to adjust the one or more actuators of the engine to keep a predicted response in each of the two or more sensor input signals within a corresponding predetermined range of values.

19. The apparatus of claim 18, wherein at least one of the engine sensor input signals correspond to an emission sensor.

20. The apparatus of claim 19, wherein the one or more actuators of the engine include a fuel injection actuator.

* * * * *